US005332513A

United States Patent [19]

Doms et al.

[11] Patent Number: 5,332,513

[45] Date of Patent: * Jul. 26, 1994

[54] PARTICULATE FABRIC SOFTENING AND DETERGENT COMPOSITIONS

[75] Inventors: Jan R. P. Doms, Tongeren; Marcel J. E. G. Gillis, Argenteau; Pierre M. Lambert, Cortil-Wodon; Paul A. Heckles, Tilff, all of Belgium; Eduardo E. Puentes-Bravo, Concepción, Chile; Anita Hermosilla M, Othee, Belgium; Jean-Paul M. H. F. Grandmaire, Andrimont, Belgium; Viviane E. A. Tack, Ayeneux, Belgium

[73] Assignee: Colgate-Palmolive Co., New York, N.Y.

[ * ] Notice: The portion of the term of this patent subsequent to Jun. 30, 2009 has been disclaimed.

[21] Appl. No.: 884,499

[22] Filed: May 15, 1992

Related U.S. Application Data

[63] Continuation-in-part of Ser. No. 755,965, Sep. 6, 1991, abandoned, and a continuation-in-part of Ser. No. 756,030, Sep. 6, 1991, abandoned, which is a continuation-in-part of Ser. No. 638,945, Jan. 9, 1990, Pat. No. 5,126,060.

[51] Int. Cl.[5] ..... D06M 10/08

[52] U.S. Cl. ..... 252/8.6; 252/8.9; 252/DIG. 1

[58] Field of Search ..... 252/8.6–8.9, 252/DIG. 1

[56] References Cited

U.S. PATENT DOCUMENTS

| | | | |
|---|---|---|---|
| 4,152,272 | 5/1979 | Young | 252/8.8 |
| 4,292,035 | 9/1981 | Battrell | 8/137 |
| 4,530,774 | 7/1985 | Davies et al. | 252/108 |
| 4,960,526 | 10/1990 | Puentes-Bravo | 252/8.8 |
| 5,126,060 | 6/1992 | Puentes-Bravo et al. | 252/8.6 |

FOREIGN PATENT DOCUMENTS 34492 3/1979 Japan .

*Primary Examiner*—Paul Lieberman
*Assistant Examiner*—Michael Tierney
*Attorney, Agent, or Firm*—Bernard Lieberman; Robert C. Sullivan

[57] ABSTRACT

A particulate fabric softening composition and a particulate fabric softening detergent composition are described, both of which include bentonite powder agglomerated into larger particulate bead or granule form with a normally solid co-melt of a pentaerythritol compound (PEC), such as pentaerythritol ditallowate (PEDT), and a nonionic surfactant, such as a condensation product of a mole of a $C_{12-15}$ fatty alcohol with seven moles of ethylene oxide. The fabric softening composition described may be added to wash (or rinse water) but preferably is incorporated in a particulate built synthetic organic anionic and/or nonionic detergent composition to produce a fabric softening detergent composition. The invented detergent compositions are especially suitable for washing laundry in "cold" water, such as water at 40° C. or thereabout, in which the nonionic surfactant increases the dispersibility of the PEC, improves fabric softening activity thereof, in conjunction with the bentonite, and also prevents excessive whitening or chalking of dark colored laundry by the particulate fabric softening composition. These improved results have been attributed to the nonionic surfactant lowering the co-melt's melting point to about 40° C. or lower, at which temperature the softening composition disperses satisfactorily in the wash water. Additional advantages of the invention are a bonus effect of the nonionic surfactant in increasing detergency of the detergent composition and wash water, and in allowing a decrease in PEC content of the softening and detergent compositions without loss of softening effect.

19 Claims, No Drawings

PARTICULATE FABRIC SOFTENING AND DETERGENT COMPOSITIONS

This application is a continuation-in-part of Ser. Nos. 7/755,965 and 07/756,030, both filed Sep. 6, 1991 both now abandoned, which are continuations-in-part of Ser. No. 07/638,945, filed Jan. 9, 1990, now U.S. Pat. No. 5,126,060.

This invention relates to fabric softening compositions. More particularly, it relates to particulate fabric softening compositions and to particulate fabric softening detergent compositions.

It has long been well known that although synthetic organic detergent compositions are excellent washing agents they tend to leave washed laundry feeling "hard" to the touch. Consequently, fabric softening compositions have been employed in the rinse to treat the washed laundry and soften it. In recent years such fabric softening agents have been incorporated in detergent compositions so that the laundry could be both washed and softened in the same operation, obviating a separate trip to the washing machine to add fabric softener to the rinse water. Among the fabric softening materials employed in detergent compositions have been the smectite clays, of which montmorillonites and especially bentonites have been most successful. In parent applications Ser. Nos. 07/638,945, now U.S. Pat. No. 5,126,060, 07/755,965 and 07/756,030 fabric softening and fabric softening detergent compositions have been described in which pentaerythritol compounds (PEC's) have been employed in conjunction with swellable bentonites to increase fabric softening activities in both fabric softening compositions and detergent compositions. The increase in fabric softening obtainable made such compositions the equal of quaternary ammonium salt based fabric softening rinses, and allowed one to make such compositions without the disadvantages associated with such "quats". However, although the bentonite/PEC compositions are effective fabric softeners in hot water washing, leaving the washed laundry soft and free of any bentonite deposition, it has been found that when such fabric softening compositions or fabric softening detergent compositions are employed in cold water, such as water at a temperature of 45° C. or lower, e.g., 40° C., there may be a tendency for the bentonite/PEC combinations to deposit on the laundry, which is especially objectionable when the laundry is dark in color because it is given a whitish cast. Such defect of the bentonite/PEC compositions has been cured by the present invention.

In accordance with this invention a particulate agglomerated fabric softening composition of improved fabric softening action and reduced tendency to objectionably discolor dark colored laundry washed in cold wash water in which the fabric softening composition is present, comprises a fabric softening clay powder agglomerated into particles with a normally solid co-melt of a mixture of pentaerythritol compound and nonionic surfactant, with the melting point of the mixture being in the range of 30° to 45° C. Also within the invention are a process for manufacturing the described fabric softening compositions, and fabric softening detergent compositions that include them.

The closest art known to applicants, other than the parent patent applications previously mentioned, include U.S. Pat. Nos. 3,928,212; 4,126,562; 4,142,978; 4,152,272; 4,162,984; and 4,214,038; EPO Specification 276999-A; German Specification 3613479-A; and Japanese Specifications 0247370 and 4821353. Although these references disclose that pentaerythritol compounds and other esters of polyhydric alcohols have been suggested for fabric softening applications, often in conjunction with quaternary ammonium salt and other cationic softeners, and although bentonite is a known fabric softener in detergent compositions and rinse preparations and some nonionic surfactants are known detergents, such do not make the present invention obvious because nowhere in the prior art is it disclosed or suggested that a fabric softening composition should be made by co-melting PEC with nonionic surfactant and then agglomerating bentonite powder with the co-melt, which is of a melting point in the 30° to 45° C. range. Neither is there any suggestion in the art of the significant advantages that are obtained from the present invention, including increased fabric softening action, little or no chalky residue on dark laundry items that are washed or treated in cold water, and better cleaning, especially of oily soils, because of the additional cleaning power of the nonionic surfactant in the fabric softening composition.

The clays that are useful components of the invented compositions are those which cooperate synergistically with the PEC's to soften laundry better than would be expected from such a mix of components, whether in particulate fabric softening compositions or whether in particulate fabric softening detergent compositions. Such clays include the montmorillonite-containing clays which have swelling properties (in water) and which are of smectite structure, so that they deposit on fibrous materials, especially cotton and cotton/synthetic blends, such as cotton/polyester, to give such fibers and fabrics made from them a surface lubricity or softness. The best of the smectite clays for use in the present invention is bentonite and the best of the bentonites are those which have a substantial swelling capability in water, such as the sodium and potassium bentonites, or which are swellable in the presence of sodium or potassium ions, such as calcium bentonite. Such swelling bentonites are also known as western or Wyoming bentonites, which are essentially sodium bentonite. Other bentonites, such as calcium bentonite, are normally non-swelling and usually are, in themselves, unacceptable as fabric softening agents. However, it has been found that such non-swelling (but swellable) bentonites exhibit even better fabric softening in combination with PEC's than do the swelling bentonites, providing that there is present in or with the softening composition a source of alkali metal or other solubilizing ion, such as sodium (which may come from sodium hydroxide, added to the composition, or from sodium salts, such as builders and fillers, which may be functional components of the composition). This utility of the normally non-swelling bentonite is surprising and the superiority of such in the invented compositions (when a source of sodium is present) over normally swelling bentonite, such as sodium bentonite, is even more surprising. Among the preferred bentonites are those of sodium and potassium, which are normally swelling, and calcium and magnesium, which are normally non-swelling, but are swellable. Of these it is preferred to utilize calcium (with a source of sodium being present) and sodium bentonites. The bentonites employed are not limited to those produced in the United States of America, such as Wyoming bentonite, but also may be obtained from Europe, including Italy and Spain, as calcium bentonite, which may be converted to sodium bentonite by treatment with sodium carbonate, or may be employed as calcium bentonite. Also, other montmorillonite-containing smectite clays of properties like those of the bentonites described may be substituted in whole or in part for the bentonites described herein and similar fabric softening results will be obtained.

The swellable bentonites and similarly operative clays are of ultimate particle sizes in the micron range, e.g., 0.01 to 20 microns and of actual particle sizes less than 100 or 150 microns, such as 40 to 150 microns or 45 to 105 microns. Such size ranges also apply to the zeolite builders, which will be described later herein. The bentonite and other such suitable swellable clays may be agglomerated to larger particle sizes too, such as up to 2 or 3 mm. in diameter but such agglomerates are not preferred unless they include the PEC and nonionic surfactant, too.

Another component of the invented particulate compositions of the present invention, which is usually the main fabric softening compound therein, other than the fabric softening clay, such as bentonite, is preferably a higher fatty acid ester of a pentaerythritol compound, which term is used in this specification to describe higher fatty acid esters of pentaerythritol, higher fatty acid esters of pentaerythritol oligomers, higher fatty acid esters of lower alkylene oxide derivatives of pentaerythritol and higher fatty acid esters of lower alkylene oxide derivatives of pentaerythritol oligomers. Pentaerythritol compound may be abbreviated as PEC herein, which description and abbreviation may apply to any or all of pentaerythritol, oligomers thereof and alkoxylated derivatives thereof, as such, or more preferably and more usually, as the esters, as may be indicated by the context.

The oligomers of pentaerythritol are preferably those of two to five pentaerythritol moieties, more preferably 2 or 3, with such moieties being joined together through etheric bonds. The lower alkylene oxide derivatives thereof are preferably of ethylene oxide or propylene oxide monomers, dimers or polymers, which terminate in hydroxyls and are joined to the pentaerythritol or oligomer of pentaerythritol through etheric linkages. Preferably there will be one to ten alkylene oxide moieties in each such alkylene oxide chain, more preferably 2 to 6, and there will be one to ten such groups on a PEC, depending on the oligomer. At least one of the PEC OH groups and preferably two, are esterified by a higher fatty acid or other higher aliphatic acid, which can be of an odd or even number of carbon atoms.

The higher fatty acid esters of the pentaerythritol compounds are preferably partial esters and more preferably there will be at least two free hydroxyls thereon after esterification (on the pentaerythritol, oligomer or alkoxyalkane groups). Frequently the number of such free hydroxyls is two or about two but sometimes it may be one, as in pentaerythritol tristearate, or as many as eight, as in pentapentaerythritol tetrapalmitate.

The higher aliphatic or fatty acids that may be employed as esterifying acids are those of carbon atom contents in the range of 8 to 24, preferably 12 to 22 and more preferably 12 to 18, e.g., lauric, myristic, palmitic, oleic, stearic and behenic acids. Such may be mixtures of such fatty acids, obtained from natural sources, such as tallow or coconut oil, e.g., pentaerythritol ditallowate (the tallow acids diester of pentaerythritol, PEDT) or from such natural materials that have been hydrogenated. Synthetic acids of odd or even numbers of carbon atoms may also be employed. Of the fatty acids lauric, stearic, coco and tallow acids are often preferred (and such preference may depend on the pentaerythritol compound being esterified).

Examples of some esters (PEC's) within the present invention follow:

MONOPENTAERYTHRITOL ESTERS

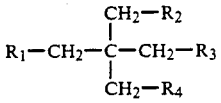

MONOPENTAERYTHRITOL DILAURATE $R_1 = CH_3-(CH_2)_{10}-COO-$ $R_2 = CH_3-(CH_2)_{10}-COO-$
$R_3 = OH$ $R_4 = OH$

MONOPENTAERYTRITOL MONOSTEARATE $R_1 = CH_3-(CH_2)_{16}-COO-$ $R_2 = OH$
$R_3 = OH$ $R_4 = OH$

DIPENTAERYTHRITOL ESTERS

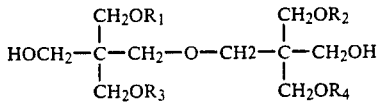

DIPENTAERYTHRITOL TETRALAURATE $R_1 = CH_3-(CH_2)_{10}-CO$ $R_2 = CH_3-(CH_2)_{10}-CO$
$R_3 = CH_3-(CH_2)_{10}-CO$ $R_4 = CH_3-(CH_2)_{10}-CO$

DIPENTAERYTHRITOL TETRASTEARATE $R_1 = CH_3-(CH_2)_{16}-CO$ $R_2 = CH_3-(CH_2)_{16}-CO$
$R_3 = CH_3-(CH_2)_{16}-CO$ $R_4 = CH_3-(CH_2)_{16}-CO$

MONOPENTAERYTHRITOL DISTEARATE $R_1 = CH_3-(CH_2)_{16}-COO-$ $R_2 = CH_3(CH_2)_{16}-COO-$
$R_3 = OH$ $R_4 = OH$

MONOPENTAERYTHRITOL TRISTEARATE $R_1 = CH_3-(CH_2)_{16}-COO-$ $R_2 = CH_3-(CH_2)_{16}-COO-$
$R_3 = CH_3-(CH_2)_{16}-COO-$ $R_4 = OH$

MONOPENTAERYTHRITOL MONOBEHENATE $R_1 = CH_3-(CH_2)_{20}-COO-$ $R_2 = OH$
$R_3 = OH$ $R_4 = OH$

MONOPENTAERYTHRITOL DIBEHENATE $R_1 = CH_3-(CH_2)_{20}-COO-$ $R_2 = CH_3-(CH_2)_{20}-COO-$
$R_3 = OH$ $R_4 = OH$

PENTAERYTHRITOL 10 ETHYLENE OXIDE ESTER

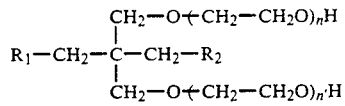

with $n + n' = 10$

MONOPENTAERYTHRITOL 10 ETHYLENE OXIDE DISTEARATE $R_1 = CH_3-(CH_2)_{16}-COO-$ $R_2 = CH_3-(CH_2)_{16}-COO-$

PENTAERYTHRITOL 4 PROPYLENE OXIDE ESTERS

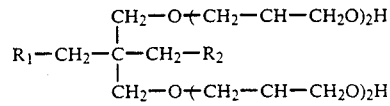

MONOPENTAERYTHRITOL 4 PROPYLENE OXIDE MONOSTEARATE $R_1 = CH_3-(CH_2)_{16}-COO-$ $R_2 = OH$

MONOPENTAERYTHRITOL 4 PROPYLENE OXIDE DISTEARATE $R_1 = CH_3-(CH_2)_{16}-COO-$ $R_2 = CH_3-(CH_2)_{16}-COO-$

MONOPENTAERYTHRITOL 4 PROPYLENE

-continued

| OXIDE MONOBEHENATE | |
|---|---|
| $R_1 = CH_3-(CH_2)_{20}-COO-$ | $R_2 = OH$ |
| MONOPENTAERYTHRITOL 4 PROPYLENE OXIDE DIBEHENATE | |
| $R_1 = CH_3-(CH_2)_{20}-COO-$ | $R_2 = CH_3-(CH_2)_{20}-COO-$ |

Although in the formulas given herein some preferred pentaerythritol compounds that are useful in the practice of this invention are illustrated it will be understood that various other such pentaerythritol compounds within the description thereof herein may be employed too, including such as pentaerythritol dihydrogenated tallowate, pentaerythritol distearate (PEDS), pentaerythritol dipalmitate, and dipentaerythritol tetratallowate. Also, in this specification when reference is to a compound of a class, unless it is indicated otherwise therein it is to be considered that the employment of mixtures of compounds of such class are intended to be included (commercial compounds are often mixtures). For example, a technical pentaerythritol ditallowate (tallow acids diester of pentaerythritol, sometimes called the distearate) comprises about 18% monoester, about 38% diester, about 32% triester and about 8% tetraester, with about 4% of unreacted pentaerythritol and tallow acids. It is desirable to minimize or limit the proportions of triester and tetraester present to avoid unduly high melting points for the PEC's.

The PEC's utilized in this invention can have fabric softening effects of their own but such activities are remarkably increased when a montmorillonite clay (bentonite) is also present. In the absence of such bentonite the PEC may be substantially undispersed in wash and rinse waters. It has been found that better dispersed PEC has greater softening activity. When undispersed, PEC could be in solid form when cold or in molten form when hot, in neither of which states does it act as effectively to soften fabrics (and in both of which cases it can deposit objectionably on treated materials to produce somewhat greasy spotting thereof). The bentonite acts to disperse the PEC to make it more effective as a softener, and at the same time such "dispersing agent" also acts as a softener, which avoids the undesirable dilution of softening action by an ordinary dispersing agent, and it synergistically improves fabric softening. However, despite the utility of bentonite as a dispersant it is often inadequate alone to disperse the PEC sufficiently in cold water (of a temperature lower than about 45° C.), which led to the present invention.

The nonionic surfactant which serves in the co-melt to lower the melting or softening point of the PEC (when a mix softens instead of melting sharply its softening or pour point will be considered as equivalent to its melting point) may be any suitable nonionic surfactant that has such ability to lower the melting point of the PEC/nonionic surfactant co-melt to the 30° to 45° C. range. Normally, cold water washing will be effected in that temperature range, so to obtain best dispersion of the fabric softening composition components it is desirable to lower the melting point of the PEC/-nonionic surfactant co-melt to such range. Still, it is desirable that the co-melt solidify at room temperature (normally 20° to 25° C.) to avoid having it bleed liquid. Although the known nonionic surfactants, as listed in *McCutcheon's Detergents and Emulsifiers Annuals*, e.g., that for 1981, may be used, if of desired melting points, it is preferable to employ those which are condensation products of a higher alcohol with a lower alkylene oxide of 2 to 4 carbon atoms, preferably ethylene oxide. Desirably, the higher alcohol is a long chain alcohol of 11 to 18 carbon atoms and preferably it is of 12 to 15 carbon atoms, e.g., 12 to 14 carbon atoms, on the average, and it will be a fatty or Oxo alcohol. The molar ratio of ethylene oxide to higher alcohol in the condensation product will usually be in the range of 1 to 10 or 11 moles of ethylene oxide per mole of alcohol, preferably 2 to 7, e.g., 2, 7, and preferably will be 7 or about 7, with seven moles of EtO per mole of $C_{12-15}$ fatty alcohol. Such nonionic surfactant has a pour point of 21° C.' and it has been found that about three parts of it per two parts of PEDT will lower the melting point of the mix to 40° C. and make the invented fabric softening composition well dispersed in cold wash or rinse water. A condensation product of two moles of ethylene oxide per mole of $C_{12-15}$ fatty alcohol solidifies at 7° C. and two parts thereof will lower the melting point of three parts of PEDT to about 40° C.

Frequently the particulate fabric softening composition of the invention will consist of only the three components described but in some instances compatible adjuvants may also be present. Among such may be named: supplementary fabric softeners, such as quaternary ammonium salts, where permissible; perfumes; stabilizers; fillers; enzymes; and fluorescent brighteners. Examples of such adjuvants are given in the art previously mentioned herein, all of which is hereby incorporated by reference. Quaternary ammonium salts and other cationic softeners will usually be omitted from the compositions because of their detrimental effects on aquatic organisms, but limited quantities of them may sometimes be tolerable, when the ecotoxicity thereof is within the limits permitted by law and regulations. Any adjuvants present should be water soluble or dispersible or should be meltable in the composition at a temperature in the range of 30° to 45° C., or should be present in small enough quantity so as not to cause a deposition problem on the laundry.

The previous description of the components of the invented compositions is directed to those in the fabric softening compositions that are intended for addition to non-softening detergent compositions to give them fabric softening properties. Alternatively, the fabric softening compositions may be employed as additives to wash waters or rinse waters. In all such cases, when the bentonite is a swelling bentonite, such as a sodium or potassium bentonite, there will be no need for the presence of any other material with the described compositions but when the bentonite is a swellable one, which should be converted to swelling form by reaction with a source of solubilizing ion, such as sodium or potassium, such a source should be present, too A suitable source of solubilizing ions is found in built detergent compositions that are built with alkali metal builder salts, such as sodium carbonate, sodium bicarbonate, sodium tripolyphosphate, borax, sodium citrate and/or sodium silicate, which may also be in the wash water or in the rinse water, or may be added to the rinse water, or to the fabric softening composition. Normally the proportion of ionizable sodium or potassium should be at least 50% of the gram equivalent of calcium or magnesium in the calcium or magnesium bentonite, and preferably it will be at least 100% and more preferably in 100% excess or more.

When the fabric softening composition is incorporated in a detergent composition to make it into a fabric softening detergent composition the active detergent will desirably be either an anionic detergent or a nonionic detergent or a mixture of the two. Even when the detergent composition is solely anionic the final product will have nonionic detersive characteristics because of the presence in the fabric softening composition component of nonionic surfactant. When the detergent composition includes nonionic detergent the amount thereof included in the formula can often be decreased because of the presence of the nonionic surfactant in the fabric softening composition component.

Among the nonionic detergents those which are most preferred are ethylene oxide condensates with higher fatty alcohols or with alkyl phenols, such as condensation products of 1 to 20, 5 to 15, 6 to 12 or 7 to 11 moles of ethylene oxide with higher fatty alcohols of 10 or 12 to 18 or 13 to 17 or 12 to 15 carbon atoms or with alkyl phenols of 7 to 10 carbon atoms in the alkyl groups, e.g., Dobanol® 25-7, Synperonic® A7, Neodol® 25-3, Neodol 25-7, Neodol 45-11, and $C_{12-15}$ or $C_{13-17}$ alcohols condensed with 7 or 11 moles of ethylene oxide per mole. Although the improved softening obtained when bentonite is employed with a PEC is noticeable in anionic, nonionic and anionic/nonionic detergent compositions, such increase in softening action is even more surprising in the case of nonionic detergent compositions because PEC alone (without bentonite) has no fabric softening action at all in nonionic detergent compositions (but does have some such action in anionic detergents).

The anionic detergents are normally of the water soluble sulfate and/or sulfonated lipophile type, which may be designated "sulf(on)ated", and which include lipophile and sulf(on)ate moieties, but analogous phosph(on)ates may also be utilized. Of the synthetic anionic organic sulf(on)ated detergents those preferred are higher alkyl (preferably linear alkyl) benzene sulfonates, higher fatty alcohol sulfates, higher fatty alcohol ethoxylate sulfates, olefin sulfonates and paraffin sulfonates. Usually such compounds are water soluble alkali metal salts, such as sodium salts, and include higher fatty alkyl or other aliphatic moieties, which serve as lipophilic moieties, and which increase detergency, especially against greasy soils. Such higher alkyl or higher aliphatic moieties will normally be of 8 to 22 carbon atoms, preferably 10 or 12 to 16 or 18 carbon atoms and more preferably, especially for the more preferred alkyl sulfates and alkylbenzene sulfonates, the alkyl moieties will be of 10 or 12 to 14 carbon atoms. The higher fatty alcohol ethoxylate sulfates that are useful will normally be of 1 to 20 ethoxy groups per mole, preferably 3 to 10 or 15, e.g., 3 or 7. As representatives of anionic detergents there may be mentioned sodium linear dodecylbenzene sulfonate, sodium linear tridecylbenzene sulfonate, sodium lauryl alcohol sulfate, sodium coco alcohol triethoxylate sulfate, sodium $C_{16}$ paraffin sulfonate and sodium olefin sulfonate derived from $C_{14}$ olefin.

In addition to the above examples of suitable anionic and nonionic detergents, extensive listings of such detergents that are useful may be found in standard textbooks relating to synthetic organic detergents, such as the McCutcheon texts, previously cited, which are incorporated herein by reference.

Of the water soluble builders for the anionic and nonionic detergents it is preferred to employ water soluble salts, such as sodium or potassium salts, more preferably sodium salts, and of these the carbonates, silicates, borates, bicarbonates and phosphates, especially the polyphosphates, are preferred, such as sodium carbonate, sodium bicarbonate, sodium silicate of $Na_2O:SiO_2$ ratio in the range of 1:1.6 to 1:3, preferably 1:2 to 1:3, e.g., about 1:2, 1:2.35 or 1:2.4, sodium tripolyphosphate, tetrasodium pyrophosphate and borax, but sodium sesquicarbonate and sodium sesquisilicate may also be used, as may be the corresponding potassium and other soluble salts, when suitable. Of the water insoluble builders, which builders also have water softening properties, the most preferred are the zeolites, especially the hydrated zeolites. Such zeolites include crystalline, amorphous and mixed crystalline and amorphous zeolites of both synthetic and natural origins, which are of satisfactorily quick and sufficiently effective activities in counteracting calcium hardness ions in wash waters. Preferably the zeolites employed are characterized as having high exchange capacities for calcium ions, which exchange capacity is normally from about 200 to 400 milligram equivalents of calcium carbonate per gram of the zeolite. Although other ion exchanging zeolites may also be utilized, often the zeolite will be of the formula $$(Na_2O)_x.(Al_2O_3)_y.(SiO_2)_z.w\ H_2O$$

wherein x is 1, y is from 0.8 to 1.2, z is from 1.3 to 3.5 and w is from 0 to 9, and preferably is 2.5 to 6. Of the crystalline zeolites that are useful those preferred include Zeolites A, X and Y, with A being more preferable, and the most preferred of these is Zeolite 4A. These zeolites are preferably in finely divided state when added to the crutcher with the synthetic detergent prior to drying, and are of ultimate particle diameters and actual sizes like those previously described for the bentonites. Other builders that may be utilized include organic compounds, which are often sequestrants for hardness ions. Such compounds include organic acids, especially hydroxy and amino polycarboxylic acids, such as citric and gluconic acids and ethylene diamine tetraacetic acid (EDTA) and nitrilotriacetic acid (NTA), all usually as their water soluble salts, e.g., sodium salts. Additional useful builders are the organic-phosphorus chelating agents, such as the Dequests®, e.g., Dequest 2046, which are manufactured by Monsanto Co.

Filler or bodying salts are often also present in the detergent compositions. Although various such salts can be employed that which is most commonly and most successfully utilized is sodium sulfate. Finally, various adjuvants may be present, too, including: enzymes, such as proteases, amylases and cellulases; antioxidants; stabilizers; fluorescent brighteners; anti-redeposition agents; foaming agents; anti-foams, such as silicone oils; colorants; buffers; pigments, such as titanium dioxide; bleaching agents; such as sodium perborate; bleach activators, such as TAED; and sequestrants and chelating agents.

The proportions of components in the fabric softening compositions of the invention will normally include 50 to 90% of the bentonite, 5 to 30% of the PEC and 5 to 45% of the nonionic surfactant, with such ranges preferably being 50 to 80%, 10 to 30% and 10 to 40%, respectively. When the PEC is a higher fatty acid ester of pentaerythritol, as is preferred, the preferred esters are the mono- and di-esters and the content of the diester will be at least 30% of the total PEC. Technical mixtures of the esters may be used and in many cases only technical mixtures will be available commercially. Pure diesters and monoesters can be employed, too, although often the results will not warrant the additional expense. For fabric softening compositions consisting of calcium or sodium bentonite, pentaerythritol ditallowate (technical) and $C_{12-15}$ fatty alcohol . 7 EtO nonionic detergent the most preferred proportions are about 65%, about 20% and about 15%, respectively. When the nonionic surfactant in the formula is $C_{12-15}$ fatty alcohol . 2 EtO instead, less of it needs to be used and the most preferred proportions will be changed to about 65%, about 20% and about 15%, respectively.

The detergent composition that is made fabric softening by being blended or formulated with the invented fabric softening composition is one which normally comprises 4 to 35% of synthetic organic detergent, 50 to 92% of builder for the detergent or a combination of builder and filler, with the builder being more than half thereof, and 3 to 15% of water. Preferably, such percentage ranges are 5 to 20%, 65 to 90% and 5 to 15%, respectively and the builder content will be more than ⅔ of the total of builder and filler. When the detergent composition contains sodium perborate as a bleaching agent, and includes pentaerythritol ditallowate and $C_{12-15}$ fatty alcohol . 7 EtO nonionic detergent, the more preferred proportions are 5 to 15% of synthetic detergent (anionic and/or nonionic), 50 to 85% of builder or combination of builder(s) and filler (sodium sulfate, anhydrous), 5 to 20% of sodium perborate (anhydrous basis) and 5 to 15% of water. In such compositions the preferred ranges for the fabric softening composition components are 55 to 75% of bentonite (preferably calcium bentonite), 10 to 20% of pentaerythritol ditallowate, and 15 to 30% of nonionic surfactant.

In the fabric softening detergent compositions, which may be made by mixing together the detergent composition and the fabric softening composition or may be made by formulating the composition from scratch, the proportions of the compositions given herein are based on mixings of the two types of compositions, but "scratch" formulas may be easily calculated from them. The proportion of fabric softening composition that is mixed with the detergent composition is any suitable proportion to result in an acceptable fabric softening detergent composition that will wash well and soften the washed laundry. Thus, the composition will include a detersive proportion of a built detergent composition and a fabric softening proportion of a fabric softening composition. Usually the percentage of the fabric softening composition in the final product will be in the range of 10 to 40%, preferably 20 to 35% and most preferably 25 to 35%. The compositions will be of particle sizes in the ranges of 100 microns to 3 mm., preferably 150 microns to 2 mm. in diameter, and they will be evenly mixed together.

To make the invented fabric softening compositions is relatively easy but it is important that the PEC and the nonionic surfactant be co-melted, after which the co-melt is deposited on the clay. The co-melt is of such a composition that its melting point (or softening or pour point) is in the range of 30° to 45° C., so that it will satisfactorily disperse when the fabric softening composition is in cold wash or rinse water. Preferably the co-melt melting point will be no higher than 43° C. and more preferably will be no higher than 40° C. The co-melt will be made by raising the temperatures of both the PEC and the nonionic surfactant to a temperature at which they are both liquid, which temperature might be in the range of 50° to 70° C., for example, often 55° to 65° C., such as 60° C. or about 60° C., for PEDT and similar pentaerythritol esters. Normally the PEC will be chosen on the basis of its fabric softening activity in conjunction with bentonite and nonionic surfactant, and on the basis of its melting point. For example, one will usually avoid employing a PEC that has a melting point in excess of 70° C. and often one will also avoid those of melting point above 65° or 60° C. because it might be difficult to lower the co-melt melting point sufficiently (ideally to 35° or 40° C.) to obtain the excellent dispersing that results in no "chalking" of dark colored laundry treated with the fabric softening composition.

The co-melt may be made in any suitable manner, as by heating the nonionic surfactant and the PEC together or by heating them separately to the co-melting temperature and mixing the melts together. The PEC is solid and the $C_{12-15}$ alcohol . 7 EtO nonionic surfactant is a paste at room temperature (20° to 25° C.). The co-melt is also normally solid at such temperature, but the co-melted mixture, after solidification at room temperature, will melt or soften at a "cold" water washing temperature, such as 40° C. or thereabout. When the co-melt is made from the PEDT and the 7 EtO nonionic surfactant the surfactant is melted at 30° C. and the PEDT is melted at 60° C. and they are mixed together and then the mix is heated to 60° C. When the 2 EtO nonionic surfactant is co-melted with the PEDT the normally liquid nonionic is mixed with the 60° C. PEDT and the liquid mix is then heated to 60° C.

After the co-melt is made, and while it is still hot, e.g., at about 60° C., it is sprayed onto a moving bed of the finely divided bentonite powder (at room temperature) which is thereby agglomerated to larger particles held together by the solidified co-melt. The mixing or tumbling of the particles may be controlled to regulate the particle sizes of the agglomerate made. Alternatively, the co-melt may be mixed with the bentonite powder to form a pasty mass, which may then be size reduced by conventional means to desired particle size range. When the benonite is calcium or magnesium bentonite there may be mixed with it a suitable proportion of a sodium potassium salt, as a source of alkali metal ion, preferably sodium ion, and such proportion can be in the range of 1/5 to 20 times or ½ to 10 times that of the bentonite, with enough being present to give the bentonite swelling characteristics. Alternatively, such alkali metal salt may be in the detergent composition employed or may be added to the rinse water.

The following examples illustrate but do not limit this invention. All parts and percentages in the examples, specification and claims are by weight and all temperatures are in °C. unless otherwise indicated.

EXAMPLE 1

| Component | Percent (by weight) |
|---|---|
| *Pentaerythritol distearate, technical | 15.0 |
| **Fatty alcohol ethylene oxide condensate nonionic surfactant | 21.2 |
| Calcium bentonite | 63.8 |

-continued

| Component | Percent (by weight) |
|---|---|
| | 100.0 |

*18.2% Pentaerythritol monostearate, 38.2% pentaerythritol distearate, 31.9% pentaerythritol tristearate, 8.3% pentaerythritol tetrastearate and 3.4% of unreacted pentaerythritol and tallow acid, available from Hoechst A.G.

**$C_{12-15}$ Oxo alcohols.7 EtO (Oxo alcohols from crached wax olefins). The alcohol may be replaced by $C_{13-14}$ Alfol ® 1412H or by $C_{13-15}$ Oxo alcohols from Ziegler olefins.

The pentaerythritol distearate is melted by being heated to 60° C., the nonionic surfactant is melted by being heated to 30° C. and the two are mixed together, after which the co-melt resulting is heated to 60° C. and the heated co-melt is mixed with the calcium bentonite powder, which is of a nominal particle size of about 150 microns in diameter and is at room temperature. The mixing is effected in a Hobart ® mixer and is continued for five minutes, until the co-melt is evenly dispersed in the bentonite. Then the mix is allowed to cool to room temperature, about 21° C., at which it forms a solid cake, which is then size-reduced to particle sizes in the range of 150 microns to 2 mm. in diameter, averaging about 0.5 to 1 mm. in diameter. The particles resulting are of improved particle strength and are satisfactorily flowable, and are capable of being automatically fed by washing machine feeding mechanisms to the wash water or the rinse water to soften laundry.

In an alternative process for manufacturing the fabric softening composition described the co-melt is sprayed onto tumbling bentonite particles in a Lodige ® mixer until the bentonite is agglomerated to the desired size range mentioned above, during which agglomeration the particles are allowed to cool to room temperature. The resulting agglomerated particles are the equivalent of those made by size reducing the cake of fabric softening composition.

The processes described above are maintained the same but instead of employing calcium bentonite a sodium bentonite is substituted (Wyoming bentonite) of essentially the same particle size range. The fabric softening composition resulting is of essentially the same physical characteristics as that of the formula based on calcium bentonite but because the bentonite is swellable without the presence of alkali metal ion it is not required that there be present with the bentonite any source of alkali metal ions. While the alkali metal ion source for the calcium bentonite may be included in a detergent composition, the wash water or the rinse water in which the fabric softening composition is used, it may also be incorporated in the fabric softening composition with the calcium bentonite, as by admixing with the calcium bentonite an equivalent weight proportion of ionizable alkali metal salt, such as sodium carbonate, sodium sulfate or sodium tripolyphosphate, which will be sufficient to make the bentonite swellable.

Although the prime object of this invention is the making of particulate fabric softening products, aqueous and aqueous alcoholic emulsions and dispersions of the fabric softening compositions may be made by emulsifying or dispersing the particulate compositions (which may be further size reduced beforehand) in appropriate liquid media (in which the liquid medium of the continuous phase will be 40 to 95%, preferably 60 to 90%). For such emulsions and dispersions there will normally also be present 0.5 to 10%, preferably 1 to 5%, of an emulsifying agent, hydrotrope and/or dispersant, such as an ethoxylated lower alkyl amine, sodium toluene sulfonate and/or polymeric electrolyte, and such products may also include a source of sodium or potassium ions when the bentonite present is calcium or magnesium bentonite. The liquid products made exhibit the same type of superior fabric softening properties as the particulate products, and do not objectionably whiten treated laundry despite the treatment being conducted in cold water, at about 40° C.

EXAMPLE 2

| Component | Percent (by weight) |
|---|---|
| Sodium linear $C_{10-13}$ alkylbenzene sulfonate, technical | 6.0 |
| Zeolite 4A (hydrated) | 19.0 |
| Sodium silicate ($Na_2O:SiO_2$ = 1:2) | 3.5 |
| Sodium maleate methacrylate copolymer | 1.1 |
| Ethylene diamine tetra(methylene phosphonate) sodium salt | 0.5 |
| Sodium carboxymethyl cellulose | 0.4 |
| Stilbene fluorescent brightener | 0.2 |
| Sodium sulfate, anhydrous | 13.54 |
| Sodium carbonate, anhydrous | 10.0 |
| Sodium perborate, monohydrate | 9.0 |
| Tetraacetyl ethylene diamine | 1.8 |
| Hydroxylamine sulfate | 0.5 |
| Enzyme blend | 0.36 |
| Sodium aluminosilicate (Tixolex 28) | 0.4 |
| Perfume | 0.55 |
| Calcium bentonite or calcium montmorillonite (swellable in presence of sodium) | 18.0 |
| Pentaerythritol distearate, technical | 4.25 |
| Nonionic surfactant ($C_{12-15}$) fatty alcohol.7 EtO) | 6.0 |
| Water | 4.9 |
| | 100.0 |

The first eight components of the formula are mixed together with water in a crutcher at a temperature of about 63° C., with the water content of the crutcher mix being about 50%, and the crutcher mix is spray dried in a countercurrent spray drying tower, with the inlet and exit air temperatures being 320° C. and 130° C., respectively. The spray dried base beads resulting are of a moisture content of about 10% and are of a particle size distribution such that less than 1% are larger than 1.7 mm., less than 25% are larger than 800 microns, less than 50% are larger than 500 microns, and at least 90% are larger than 150 microns, in diameter.

The calcium bentonite, pentaerythritol distearate and nonionic surfactant are made into a particulate fabric softening composition in the manner described in Example 1, of particle sizes like those of the base beads. Then the sodium carbonate, fabric softening composition, sodium perborate monohydrate, TAED, hydroxylamine sulfate, enzyme blend, and Tixolex 28 are blended in with the base beads and the perfume is oversprayed onto the particulate mixture. The finished fabric softening detergent composition is of a moisture content of about 4.9% and of particle sizes like those of the base beads, as previously described.

The fabric softening detergent composition is tested against a control composition of the same formula, with the only difference between the products being in the experimental having a co-melt of PEDS and nonionic surfactant being mixed in liquid state with the bentonite powder while the control has the PEDS mixed with the bentonite, with the liquid state nonionic surfactant being after-sprayed onto the balance of the formula, with or separate from the perfume. Testing is by actual multiple (3) washings of laundry in a Miele Model 718 automatic tumbler type washing machine in 40° C. water of 400 p.p.m. $Ca^{++}/Mg^{++}$ (4:1) hardness, using 1% of detergent composition, and the washed specimens are compared after line drying to evaluate cleaning and fabric softening actions of the test composition and the control. Surprisingly, it is found that the experimental product washes better and the washed product feels softer to an evaluation jury. Similar results are obtained when similar comparisons are made to leading commercial fabric softening detergent compositions and fabric softening action is considered to be equivalent to or better than with such products. Such results are also obtained when the testing is in wash water at more elevated temperatures, such as 60° C.

An important improvement found in the invented compositions is in the lack of deposition of bentonite and PEDS on the washed laundry, washed in cold water (40° C.), which is considered to be a significant detriment of the control bentonite/PEDS detergent composition that has the nonionic detergent post-sprayed onto it. Such negative effects are objectionably visible when the laundry washed is dark colored, because the color becomes lightened and chalky in appearance, rather than clear and bright. Such problem with the control is not noted at elevated temperatures, of 60° C. and higher, but because much washing is done at lower temperatures the advantage for the invented compositions is significant.

The laundry washed with the invented product is of such improved fabric softening and cleaning power that the PEDS content thereof could be lowered to 4.25% in the fabric softening agglomerate component thereof, from the 6% that had been considered as desirable previous to the present invention. Such improvements are attributable to the presence of the nonionic surfactant in the co-melt with the PEDS. Such decrease in the content of the PEDS is believed to lessen any tendency toward objectionable whitening of dark colored laundry but such improvement in color integrity of washed laundry is also obtained when the PEDS is present in the detergent composition at a 6% concentration and when its content in the fabric softening composition is increased accordingly.

Other advantages that result from the present invention include the ability to spray dry stronger and higher density base beads because of the post-addition of the bentonite/PEDS/nonionic surfactant softening composition, the decrease in tackiness of the detergent composition because the nonionic detergent is not over-sprayed onto the beads near the end of the manufacturing process, and the obtaining of the detersive properties of the nonionic surfactant as a bonus (because it performs dual functions in the product).

EXAMPLE 3

The composition of Example 2 is modified by utilizing 18% of the bentonite, 4.25% of the PEDS and 2.8% of $C_{12-15}$ fatty alcohol . 2 EtO condensate nonionic surfactant in the agglomerated fabric softening component of the detergent composition. It is found that that agglomerate also is an excellent fabric softening agent and converts the basic detergent composition to one that is also fabric softening, and which cleans and softens laundry washed or treated in cold water (40° C.) without objectionably whitening dark colored laundry items. The difference of 3.2% in the product formula is compensated for with post sprayed or crutcher added nonionic detergent or surfactant or alternatively, in some instances, sodium sulfate or other detergent composition component(s) may be increased.

EXAMPLE 4

In other variations of the detergent composition and fabric softening composition formulas of Examples 1 and 2, instead of the calcium bentonite being utilized sodium bentonite (Wyoming bentonite) is substituted for it part for part. The products resulting will exhibit the same improved detergency, fabric softening and lack of objectionable whitening of dark laundry items that was described above. Additionally, because the bentonite employed is an alkali metal bentonite, which is swellable, there is no need for the presence of any alkali metal ion source in the fabric softening composition.

EXAMPLE 5

The detergent composition of Example 2 is what is described as a non-phosphate composition, which is based on a combination of anionic and nonionic synthetic organic detergents/surfactants. However, where permitted, sodium tripolyphosphate may be substituted for the zeolite of the formula, the synthetic detergent component may be solely anionic or nonionic, and the builders and adjuvants may be varied accordingly, and the same desirable results attributable to the described invention will be obtainable.

EXAMPLE 6

In the foregoing examples of both the fabric softening and fabric softening detergent compositions there may be substituted others of the equivalent components mentioned in the foregoing specification and the proportions and percentages may be varied within the ranges given and ±10% or ±25% from those of the formulas. The resulting compositions will possess the desired characteristics previously noted and will be within the present invention.

This invention has been described with respect to various illustrations and working embodiments thereof but it is not to be limited to those because it is evident that those of skill in the art, with the present specification before them will be able to utilize substitutes and equivalents without departing from the invention.

What is claimed is:

1. A particulate agglomerated fabric softening composition of improved fabric softening action and reduced tendency to objectionably discolor dark colored laundry washed in cold wash water in which the fabric softening composition is present, which comprises 50 to 90% by weight of a fabric softening clay powder agglomerated into particles with a normally solid co-melt of a mixture of a pentaerythritol ester of a higher fatty acid of 12 to 18 carbon atoms and nonionic surfactant, with the melting point of said mixture being in the range of 30° to 45° C. and the proportions being such that said fabric softening composition comprises 5 to 30% of said pentaerythritol ester of higher fatty acid and 5 to 45% of said nonionic surfactant.

2. A fabric softening composition according to claim 1 wherein said nonionic surfactant is a condensation product of an alcohol of 10 to 18 carbon atoms with ethylene oxide, said clay is a bentonite, and the particle sizes of the agglomerated composition are within the range of 100 microns to 3 millimeters in diameter.

3. A fabric softening composition according to claim 2 wherein the pentaerythritol ester includes a monoester or a diester of a higher fatty acid of 12 to 18 carbon atoms or mixtures thereof, the nonionic surfactant is a condensation product of a higher alcohol of 11 to 18 carbon atoms with ethylene oxide, and the bentonite is a swellable sodium or calcium bentonite.

4. A fabric softening composition according to claim 3 wherein the pentaerythritol ester is a mixture of two or more esters selected from the group consisting of pentaerythritol monoesters, pentaerythritol diesters and pentaerythritol triesters, the nonionic surfactant is a condensation product of one mole of a fatty alcohol of 12 to 15 carbon atoms with 1 to 10 moles of ethylene oxide, and the proportions of said nonionic surfactant in the composition is such that the melting point of said ester-surfactant mixture is in the range of 35° to 43° C.

5. A fabric softening composition according to claim 4 wherein at least 30% of the pentaerythritol ester mixture is the diester and the proportions of bentonite, pentaerythritol ester mix and nonionic surfactant are in the ranges of 50 to 80%, 10 to 30% and 10 to 40%, respectively.

6. A fabric softening composition according to claim 5 which comprises about 65% of bentonite, about 15% of pentaerythritol ditallowate and about 20% of a nonionic surfactant which is a condensation product of one mole of $C_{12-15}$ fatty alcohol and about seven moles of ethylene oxide.

7. A fabric softening composition according to claim 5 which comprises about 65% of bentonite, about 20% of pentaerythritol ditallowate and about 15% of a nonionic surfactant which is a condensation product of one mole of $C_{12-15}$ fatty alcohol and about two moles of ethylene oxide.

8. A fabric softening composition according to claim 3 wherein the sizes of the agglomerated particles are in the range of 150 microns to 2 mm. in diameter, the pentaerythritol ester is pentaerythritol ditallowate, the nonionic surfactant is a condensation product of a $C_{12-15}$ fatty alcohol with ethylene oxide, and the bentonite is sodium bentonite.

9. A fabric softening composition according to claim 6 wherein the bentonite is sodium bentonite.

10. A fabric softening composition according to claim 6 wherein the bentonite is calcium bentonite that is swellable in water in the presence of sodium ions, and there is present in the composition or with it or in water in which it is to be dispersed, a water soluble alkali metal salt in a proportion from ½ to 10 times that of the calcium bentonite.

11. A process for manufacturing a particulate agglomerated fabric softening composition which comprises melting together a pentaerythritol ester of a higher fatty acid of 12 to 18 carbon atoms and a nonionic surfactant, the mixture of which ester and surfactant has a melting point in the range of 30° to 45° C., and mixing said melt with a fabric softening clay powder so that the powder is agglomerated into larger particles or a mass, cooling said agglomerated particles or mass to room temperature and size reducing said mass or size reducing or removing particles of said agglomerate, which final agglomerate comprises 50 to 90% by weight of the fabric softening clay powder, 5 to 30% by weight of said pentaerythritol ester of fatty acid of 12 to 18 carbon atoms and 5 to 45% by weight of said nonionic surfactant.

12. A process according to claim 11 wherein ester the nonionic surfactant is a condensation product of $C_{12-18}$ alcohol with ethylene oxide, the clay is a bentonite, the mixture of pentaerythritol ester and nonionic surfactant has a melting point no higher than 43° C., the clay initially is of a particle size less than 100 microns in diameter, the temperature of the melted mixture of pentaerythritol ester and nonionic surfactant when it is mixed with the bentonite is in the range of 50° to 70° C., the particulate agglomerate product is of particle sizes in the range of 100 microns to 3 mm. in diameter, and the mixed melt is mixed with the bentonite powder to agglomerate it by depositing it onto moving surfaces of such powder.

13. A process according to claim 13 wherein the bentonite is selected from the group consisting of sodium bentonite, calcium bentonite and mixtures thereof, the pentaerythritol ester is selected from the group consisting of pentaerythritol monoesters of $C_{12-18}$ fatty acids, pentaerythritol diesters of $C_{12-18}$ fatty acids and mixtures thereof, the nonionic surfactant is a condensation product of a $C_{11-18}$ fatty alcohol with ethylene oxide, the mixture of pentaerythritol ester and nonionic surfactant is at a temperature in the range of 55° to 65° C. when it is deposited on the bentonite, and the agglomerated particles are of particle sizes in the range of 150 microns to 2 millimeters in diameter.

14. A process according to claim 13 wherein the bentonite is swellable calcium bentonite, the pentaerythritol ester is pentaerythritol ditallowate, the nonionic surfactant is a condensation product of one mole of a $C_{12-15}$ fatty alcohol and about seven moles of ethylene oxide, with the proportion of pentaerythritol ditallowate to nonionic surfactant being such that the melting point of the mixture is about 40° C., and the proportions of calcium bentonite, pentaerythritol ditallowate and nonionic surfactant are about 65%, about 15% and about 20%, respectively.

15. A fabric softening particulate detergent composition comprising a particulate detergent composition having mixed with it a particulate fabric softening composition of claim 1.

16. A fabric softening particulate detergent composition according to claim 15 which comprises a particulate detergent composition which includes a detersive proportion of anionic and/or nonionic detergent and a building proportion of a builder for the detergent, with said particulate fabric softening composition evenly mixed therewith.

17. A particulate fabric softening detergent composition according to claim 16 which comprises a particulate detergent composition containing 4 to 35% of synthetic organic detergent selected from the group consisting of anionic and nonionic detergents and mixtures thereof, 50 to 92% of builder for the detergent or a combination of builder and filler, with the builder being more than half thereof, and 3 to 15% of water, having mixed with it a particulate fabric softening composition comprising 50 to 90% of bentonite, 5 to 30% of pentaerythritol $C_{12-18}$ fatty acid diester, and 5 to 45% of nonionic surfactant, with the percentage of the particulate fabric softening composition in the particulate fabric softening detergent composition being in the range of 10 to 40%, and the sizes of the particles of the fabric softening detergent composition are in the range of 100 microns to 3 mm. in diameter.

18. A particulate fabric softening detergent composition according to claim 17 wherein the particulate detergent composition thereof comprises 5 to 20% of synthetic organic detergent which is a condensation product of higher fatty alcohol with ethylene oxide, sodium higher alkylbenzene sulfonate or sodium higher alkyl sulfate or any mixture thereof, 65 to 90% of a builder for the synthetic organic detergent, which builder is sodium polyphosphate, sodium citrate, sodium carbonate, sodium silicate, sodium bicarbonate, borax or zeolite or any mixture thereof, or a combination of such builder(s) and filler, with the filler being sodium sulfate and with the builder being more than ⅔ of such combination, and 5 to 15% of water, and the particulate fabric softening composition comprises 50 to 80% of sodium and/or calcium bentonite, 10 to 30% of pentaerythritol $C_{12-18}$ fatty acid diester and 10 to 40% of nonionic surfactant, which is a condensation product of a mole of a $C_{11-18}$ fatty alcohol with 1 to 11 moles of ethylene oxide, with the percentage of particulate fabric softening composition in the particulate fabric softening detergent composition being in the range of 20 to 35%, and the sizes of the particles of the fabric softening detergent composition are in the range of 150 microns to 2 mm. in diameter.

19. A particulate fabric softening detergent composition according to claim 18 wherein the particulate detergent composition thereof comprises 5 to 15% of synthetic anionic and/or nonionic detergent, 50 to 85% of builder for the detergent(s) or combination of builder(s) and sodium sulfate, 5 to 20% of sodium perborate and 5 to 15% of water, the particulate fabric softening composition comprises 55 to 75% of calcium bentonite, 10 to 20% of pentaerythritol ditallowate and 15 to 30% of a nonionic surfactant which is a condensation product of one mole of $C_{12-15}$ fatty alcohol and seven moles of ethylene oxide, and the percentage of the particulate fabric softening composition in the particulate fabric softening detergent composition is in the range of 25 to 35%.

* * * * *